US005452776A

United States Patent [19]

Köhler

[11] Patent Number: 5,452,776

[45] Date of Patent: Sep. 26, 1995

[54] BLOCK BRAKE FOR RAIL VEHICLES

[75] Inventor: Günter Köhler, Siegen, Germany

[73] Assignee: ABB Henschel Waggon Union GmbH, Berlin, Germany

[21] Appl. No.: 285,868

[22] Filed: Aug. 4, 1994

Related U.S. Application Data

[63] Continuation of PCT/EP93/03289, Nov. 24, 1993.

[30] Foreign Application Priority Data

Dec. 5, 1992 [DE] Germany ..... 42 40 974.8

[51] Int. Cl.[6] ..... B60T 1/06; B61H 1/00

[52] U.S. Cl. ..... 188/58; 188/56; 188/75

[58] Field of Search ..... 188/56, 206 R, 188/74, 153 R, 153 A, 153 D, 33, 58, 365, 17, 49–51, 75, 76, 219.1, 46, 233

[56] References Cited

U.S. PATENT DOCUMENTS 2,155,222 4/1939 Farmer ..... 188/58
2,169,751 10/1938 Williamson .
2,191,821 2/1940 Down ..... 188/58
2,194,745 3/1940 Farmer ..... 188/58
2,221,714 9/1938 McGowan .

FOREIGN PATENT DOCUMENTS 35707 6/1935 Netherlands .

*Primary Examiner*—Douglas C. Butler
*Attorney, Agent, or Firm*—Hervert L. Lerner; Laurence A. Greenberg

[57] ABSTRACT

Rail vehicles have a brake linkage being acted on by a brake cylinder for acting on at least one wheel set of a bogie, truck or running gear of the rail vehicle through brake blocks having brake block shoes and brake block shoe inserts. A block brake for rail vehicles should be economical and be constructed in such a way that higher braking capacities can be achieved, that damage to the tires of the wheels of the wheel set is avoided and that wheel noise of the wheel sets is minimized. The block brake includes at least one rotationally symmetrical brake body being fixedly disposed on a wheel set shaft of the wheel set between the wheel discs of the wheel set. The acted-on brake block rests on an outer surface of the brake body.

8 Claims, 3 Drawing Sheets

BLOCK BRAKE FOR RAIL VEHICLES

CROSS-REFERENCE TO RELATED APPLICATION

This application is a Continuation of International Application Ser. No. PCT/EP93/03289, filed Nov. 24, 1993.

BACKGROUND OF THE INVENTION

1. Field of the Invention

The invention relates to a block brake for rail vehicles in which a brake linkage is acted on by a brake cylinder and acts radially on at least one wheel set of a bogie, truck or running gear of the rail vehicle through brake blocks which include brake block shoes and brake block shoe inserts.

In practice, brake blocks for rail vehicles are known, in particular in the field of freight traffic, through which the entire braking of the rail vehicle takes place up to a maximum permissible speed of 120 km/h. In those known block brakes, the brake blocks which include brake block shoes and brake block shoe inserts act directly on the running tread of the tire of the wheel of the wheel set. The brake blocks are attached on a brake beam which is usually configured in the shape of a triangle (brake triangle). The brake block shoes with the brake beam are mounted in an articulated fashion in the rail vehicle or in the bogie of the rail vehicle on its frame and are acted on by a brake cylinder through a brake pull rod with the intermediate connection of the center brake linkage and possible connecting levers between the brake beams.

Such a block brake which is described above fulfills its function satisfactorily up to the aforesaid speed with loads of up to 22.5 t per axle, which is customary in freight traffic, and includes simple components which are economical to manufacture and can be serviced with a low degree of expenditure. However, it has proven a disadvantage that the braking heat which is produced during braking leads to damage to the tire of the wheel and to the running tread.

The consequence thereof is a rough and bumpy running tread and possibly even the formation of fractures in the running tread. As a result of the mechanical effect of the brake blocks on the running tread, corrugations are additionally formed on the running tread. As a result of those changes to the running tread of the tire of the wheel, a very loud wheel noise is produced. When the tire of the wheel is damaged as a result of the formation of fractures, the wheel set must be replaced.

It is also a disadvantage that in order to limit the braking heat produced during braking, the permissible braking capacities are far below the range which would be theoretically achievable.

SUMMARY OF THE INVENTION

It is accordingly an object of the invention to provide a block brake for rail vehicles, which overcomes the hereinafore-mentioned disadvantages of the heretofore-known devices of this general type, which is per se economical, and which is constructed in such a way that higher braking capacities can be achieved, that damage to the tires of the wheels of the wheel set is avoided and that the wheel noise of the wheel sets is minimized.

With the foregoing and other objects in view there is provided, in accordance with the invention, in a rail vehicle including a bogie having at least one wheel set with a wheel set shaft and wheel discs, a brake cylinder, brake blocks including brake block shoes and brake block shoe inserts, and a brake linkage being acted upon by the brake cylinder and acting radially upon the at least one wheel set through the brake blocks, a block brake for the rail vehicle, comprising at least one rotationally symmetrical brake body being fixedly or permanently disposed on the wheel set shaft between the wheel discs, the at least one brake body having an outer surface on which the acted-upon brake block rests.

By virtue of this measure according to the invention, the simple and economical components of the known block brake are basically preserved and at the same time possible means are provided of realizing higher braking capacities, of keeping the running tread of the tire of the wheel free from braking heat and of avoiding the formation of corrugations on the running tread.

In accordance with another feature of the invention, in each case at least one brake block can be provided on each side of the wheel set shaft, and both brake blocks, acting radially on the wheel set shaft, rest on the outer surface of the brake body when activated.

Through the use of this feature of the invention, the wheel axle is kept free from supplementary longitudinal forces so that even during the braking process the wheel set can adjust itself to the course of the track to the greatest possible degree.

In accordance with a further feature of the invention, two or more brake bodies are disposed on the wheel set shaft and for each brake body in each case one brake block which acts on the body is disposed on each side of the wheel set shaft. A higher braking capacity can be achieved by increasing the number of brake bodies on a wheel set shaft.

In accordance with an added feature of the invention, the brake block shoes are attached on brake block hangers and mounted on a brake beam.

In accordance with an additional feature of the invention, when two brake bodies are disposed on the wheel set shaft the brake beam is constructed as a brake triangle. Through the use of this configuration according to the invention and the construction of the brake components, the greatest possible degree of approximation to the customary block brakes is achieved and thus a simple and economical structure of the block brake according to the invention is ensured.

In accordance with yet another feature of the invention, each brake block can be guided axially on the brake body.

In accordance with a concomitant feature of the invention, the brake beam is guided laterally on the frame of the bogie or the subframe of the rail vehicle. By virtue of these measures, the lateral guidance of the brake blocks and thus the operating reliability are ensured.

Other features which are considered as characteristic for the invention are set forth in the appended claims.

Although the invention is illustrated and described herein as embodied in a block brake for rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
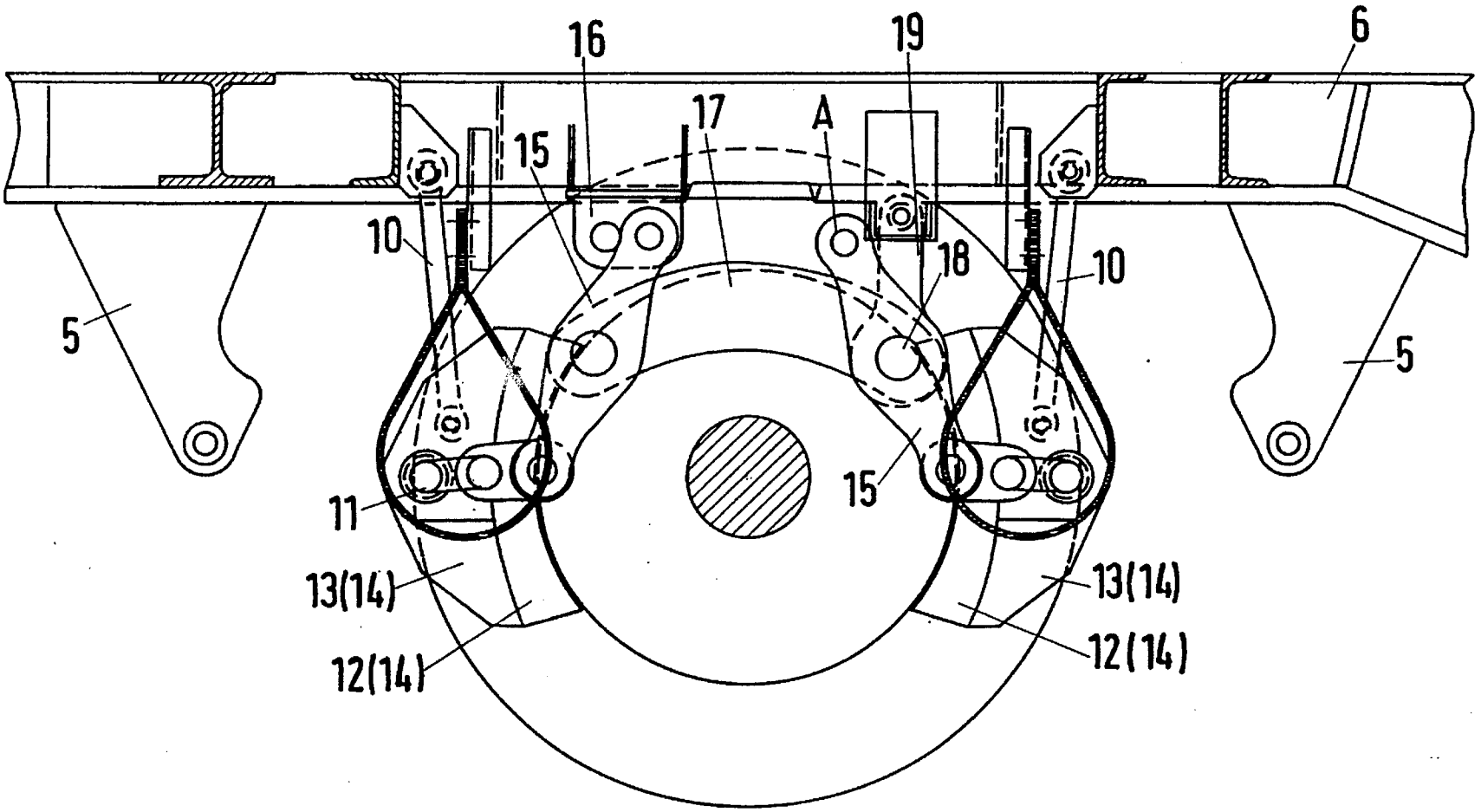
FIG. 1 is a fragmentary, diagrammatic, vertical longitudinal-sectional view of part of a bogie of a rail vehicle with a block brake according to the invention.
Figure 2:
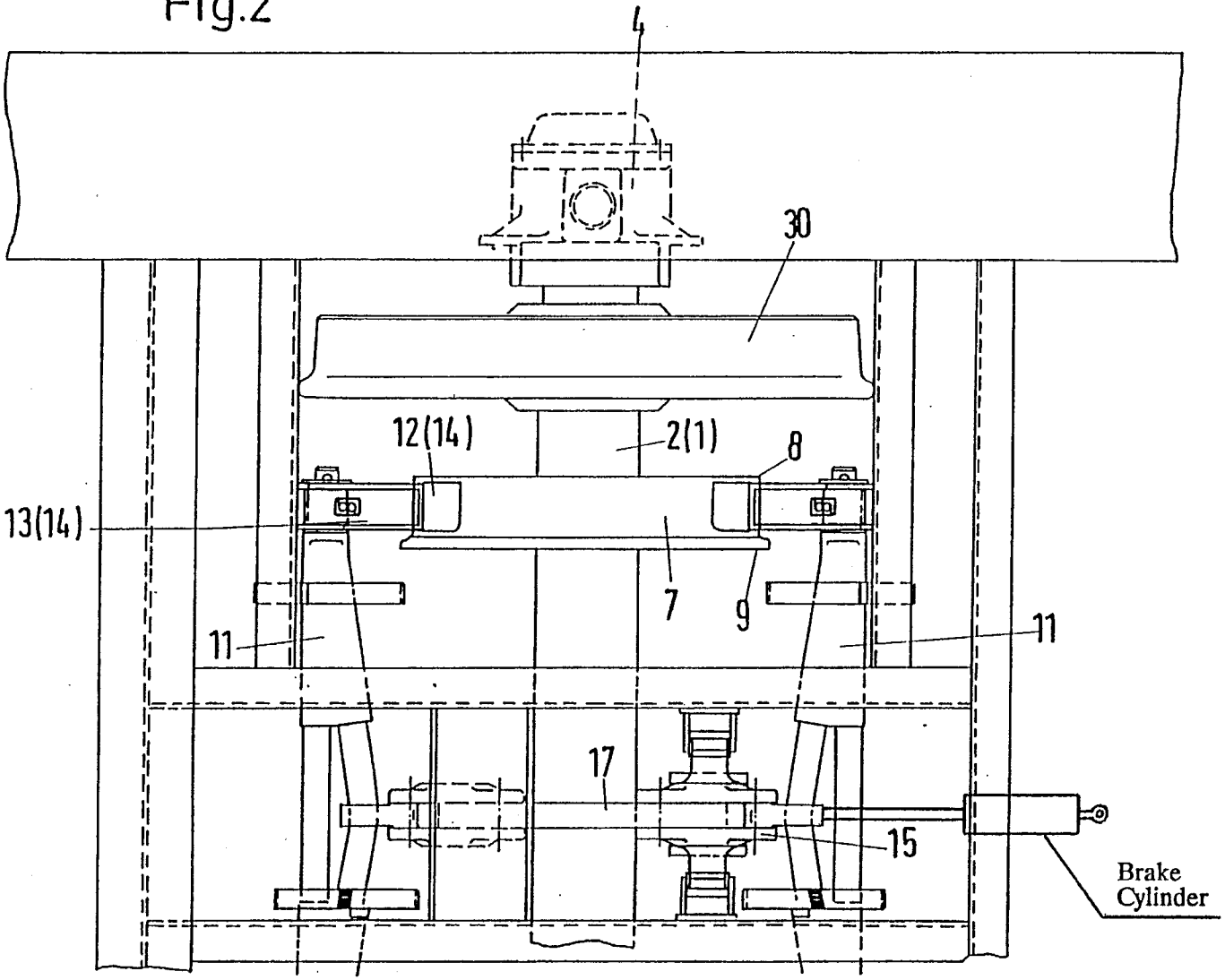
FIG. 2 is a fragmentary plan view of a part of the bogie according to FIG. 1.
Figure 3:
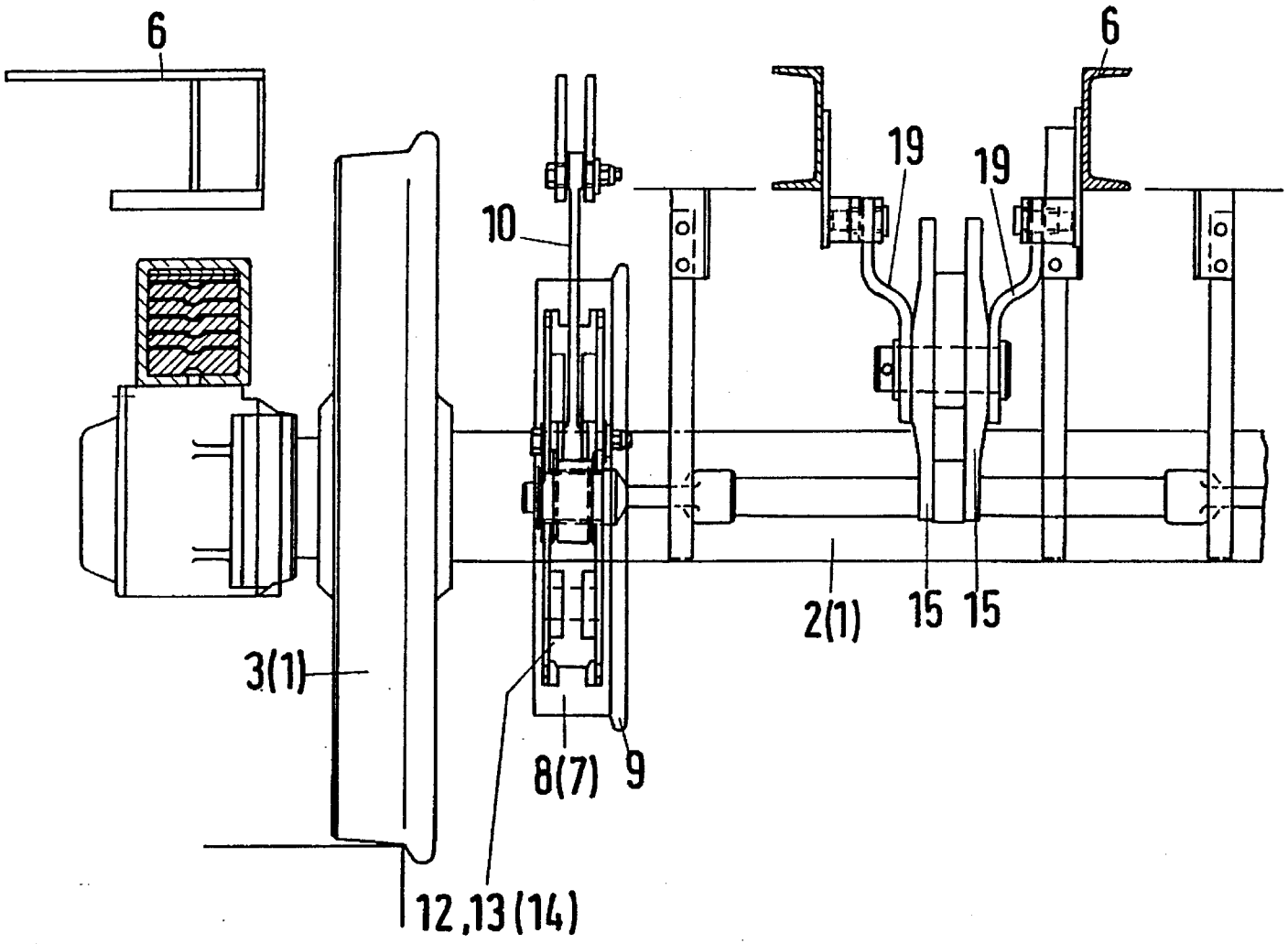
FIG. 3 is a front-elevational view of the part of the bogie according to FIG. 1.

Referring now in detail to the figures of the drawing as a whole, there is seen an exemplary embodiment of the invention which is illustrated on the bogie, truck or running gear of a double-axle railway freight car. As is known in practice, a wheel set 1 which essentially includes a wheel set shaft 2 with wheel discs 3 in this case is attached, by means of external axle bearings 4 and non-illustrated leaf suspension springs with an intermediate connection of likewise non-illustrated link suspensions, to a suspension or spring bracket 5 of a subframe 6 of the railway freight car. In each case one rotationally symmetrical brake body 7 is fixedly disposed in terms of rotation on the wheel set shaft 2 on each side of the center longitudinal axis of the railway freight car, between the wheel discs 3 of the wheel set 1. The rotationally symmetrical brake body 7 in this case has a cylindrical outer surface 8 and a wheel flange 9 which protrudes beyond the outer surface 8.

In the subframe 6 of the railway freight car, in each case one brake beam 11 is attached in an articulated fashion by brake block hangers 10 on each side of the wheel set 1. In each case the brake beam 11 has two longitudinal ends which carry one brake block 14 including a brake block shoe insert 12 and a brake block shoe 13. The brake block shoe inserts 12 of each brake block shoe 13 are located in front of the outer surface 8 of the brake body 7.

In the center, each brake beam 11 is attached to a brake lever 15 in an articulated fashion. A first brake lever 15 is mounted with its upwardly protruding end in an articulated fashion to a fixed point bearing 16 of the subframe 6 of the railway freight car. A second brake lever 15 carries a non-illustrated brake pull rod at its upper free end (designated by reference symbol A). In the center, the two brake levers 15 are connected to one another in an articulated fashion by means of a brake lever connector 17. The brake lever 15 which carries the brake pull rod is also connected to a brake hanger 19 in an articulated fashion through a joint 18 thereof which carries the brake lever connector 17. The brake hanger 19 is also attached to the subframe 6 of the railway freight car in an articulated fashion.

Through the use of the non-illustrated brake pull rod and a likewise non-illustrated center brake linkage which is known from practice, the wheel set 1 is braked by means of a brake cylinder with the brake blocks 14 being pressed against the outer surface 8 of the brake body 7 by means of the brake block shoe inserts 12.

According to the invention it is also conceivable to place a wheel flange on each longitudinal side of the brake body 7 instead of using one wheel flange 9 of the brake body 7, or to provide the outer surface 8 of the brake body 7 with a contour, for example a convex or concave contour, which guides the brake block 14 laterally. It is also conceivable, for the purpose of guiding the brake beam 11 laterally, to guide the beam 11 in the subframe of the railway freight car by means of lateral guides.

Basically, with the block brake according to the invention, the guidance of the brake blocks 14 on the brake body 7 can take place firstly in such a way that the required transverse movements of the wheel set 1 take place in relation to the brake beam 11 and thus in relation to the brake block 14 and secondly in such a way that the transverse movements of the wheel set 1 are transmitted to the brake beam 11 and thus to the brake blocks 14, and that the axle braking linkage which includes the brake blocks and the brake beam also oscillates during these transverse movements.

I claim:

1. In a rail vehicle including a bogie having at least one wheel set with a wheel set shaft and wheel discs, a brake cylinder, brake blocks including brake block shoes and brake block shoe inserts, and a brake linkage being acted upon by the brake cylinder and acting radially upon the at least one wheel set through the brake blocks, a block assembly for the rail vehicle, comprising at least one rotationally symmetrical brake body fixedly disposed on the wheel set shaft between the wheel discs, said at least one brake body having an outer surface on which the acted-upon brake block rests; and means for axially guiding each brake block on said brake body.

2. The block brake according to claim 1, wherein the wheel set shaft has two sides, and the brake blocks include at least one brake block disposed on each respective side of the wheel set shaft, the brake blocks acting radially on the wheel set shaft resting on said outer surface of said brake body when activated.

3. The block brake according to claim 1, wherein the wheel set shaft has two sides, said at least one brake body includes at least two brake bodies disposed on the wheel set shaft, and the brake blocks include a respective brake block being disposed on each side of the wheel set shaft for acting upon said brake body.

4. The block brake according to claim 1, including brake block hangers to which the brake block shoes are attached, and a brake beam on which the brake block shoes are mounted.

5. The block brake according to claim 4, wherein said at least one brake body includes at least two brake bodies disposed on the wheel set shaft, and said brake beam is a brake triangle.

6. The block brake according to claim 1, wherein the bogie has a frame, and including means for axially guiding said brake beam on the frame.

7. The block brake according to claim 1, wherein the rail vehicle has a subframe, and including means for axially guiding said brake beam on the subframe.

8. In a rail vehicle with a bogie having a wheelset with wheel discs and a wheelset shaft connecting the wheel discs, a brake system comprising a brake cylinder, brake linkage connected to an acted upon by said brake cylinder, brake blocks connected to said brake linkage, said brake blocks including brake block shoes and brake block shoe inserts, a rotationally symmetrical brake body fixedly mounted on said wheelset shaft, said brake body having an outer surface on which said brake block rests, and means for axially guiding said brake block on said brake body.

* * * * *